United States Patent [19]

Price

[11] 3,952,876

[45] Apr. 27, 1976

[54] STORAGE RACK FOR PAPERS

[76] Inventor: David D. Price, 1435 Duffner, Oklahoma City, Okla. 73118

[22] Filed: Aug. 14, 1974

[21] Appl. No.: 497,181

[52] U.S. Cl. ..... 211/50; 248/146; 248/175; 211/181

[51] Int. Cl.[2] ..... A47F 7/00; A47G 23/02

[58] Field of Search ..... 211/50, 60 A, 126, 133, 211/181; 248/127, 146, 175

[56] References Cited

UNITED STATES PATENTS

| | | | |
|---|---|---|---|
| 723,381 | 3/1903 | Hagan | 211/50 |
| 904,080 | 11/1908 | Orin | 211/50 |
| 1,655,004 | 1/1928 | Yurachek | 248/175 X |
| 2,521,126 | 9/1950 | Price | 211/50 |
| 2,927,697 | 3/1960 | Hoover | 211/50 |
| 3,784,026 | 1/1974 | Grosse | 211/181 |
| D162,226 | 2/1951 | Rippe | 211/50 X |

*Primary Examiner*—Roy D. Frazier
*Assistant Examiner*—Terrell P. Lewis
*Attorney, Agent, or Firm*—Dunlap, Codding & McCarthy

[57] ABSTRACT

A storage rack for accumulating and temporarily storing papers, such as old newspapers, wherein the rack is constructed of wire or rods.

1 Claim, 4 Drawing Figures

STORAGE RACK FOR PAPERS

BACKGROUND OF THE INVENTION

1. Field of the Invention

This invention relates generally to racks for storing and accumulating newspapers, magazines or the like. More particularly, but not by way of limitation, the invention relates to an improvement in the construction of said racks by utilizing a heavy guage wire for the construction of said racks.

2. Description of the Prior Art

Devices for storing papers are well known in the art and their method of construction is generally described in this applicant's prior issued U.S. Pat. Nos. 2,521,126 and 2,965,016. The racks shown in those patents are constructed of strips of sheet metal and plastic, respectively, both of which materials are presently expensive and difficult to obtain, and the tools necessary for forming such racks are more expensive than the tools necessary for constructing a rack of wire-like material.

SUMMARY OF THE INVENTION

An object of the present invention is to provide a rack for the purposes described having a simplified construction.

Another object of the invention is to provide a rack which may be economically manufactured.

A further object of the invention is to provide a rack which is collapsible and requires only a small amount of storage space.

Other objects and advantages will be apparent from the following description when read in conjunction with the accompanying sheet of drawings.

DESCRIPTION OF THE PREFERRED EMBODIMENT

Figure 1:
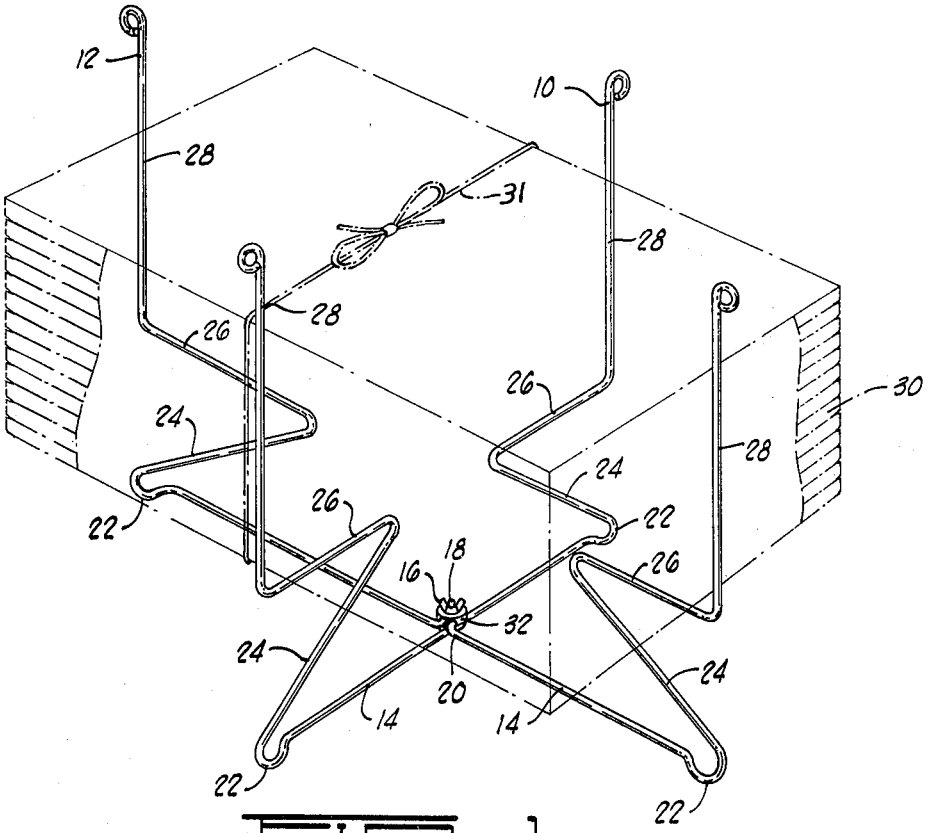
FIG. 1 is a perspective view of the rack with dotted lines depicting a stack of accumulated papers.

As shown in FIG. 1 of the drawing, the device consists of two substantially identical wire members 10 and 12 of at least 14 guage or heavier. Each member has an elongated lower portion 14 crossing the other intermediate the ends of the lower elongated portions. The members 10 and 12 are pivotally connected together by a nut 16 and bolt 18 extending through the central substantially semi-circular shaped bends 20 in the members 10 and 12.

Each member 10 and 12 further consists of a downwardly extending loop portion 22 located at the ends of the respective elongated horizontal portion 14, the loop portion 22 forming a foot which supports the device in an assembled position.

Above each loop portion 22, the members 10 and 12 have a slanting portion 24 which extends inwardly and upwardly and which at its upper end is bent outwardly as shown in FIG. 1 to form a substantially horizontal shelf portion 26. Each shelf portion 26 extends outwardly a predetermined distance and at its outer end is bent upwardly to form a vertical retaining arm 28.

Tiers of superimposed newspapers 30 (as shown in dotted lines in FIG. 1) may be folded and laid upon the horizontal shelf portions 26 and within the vertical retaining arms 28.

When a desired number of newspapers have been accumulated, string or rope 31 may be placed beneath an accumulated stack and the string or rope may be tied circumferentially about the stack between the shelf portions 26 to secure the papers. The stack may then be lifted upwardly from between the vertical retaining arms 28.

When the rack is not in use, the members 10 and 12 may be swung together by loosening the bolt 18 and wing nut 16 which then act as a pivot. It is therefore possible to store the rack in a confined space.

The members 10 and 12 are virtually identical in all respects except that the lower elongated portion 14 of the member 10 is shorter than the lower elongated portion of the member 12.

Figure 2:
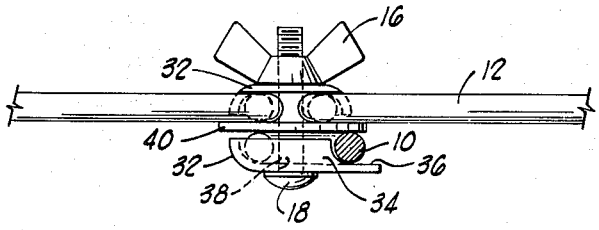
FIG. 2 is a side view of a pivotal connection between the rack members of FIG. 1.
Figure 4:
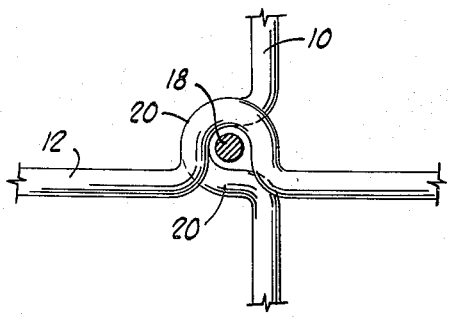
FIG. 4 is a top view of the rack members at the pivotal connection of FIG. 2 with the retainers removed.

As shown more clearly in FIGS. 2 and 4, the pivotal connection of members 10 and 12 is achieved by creating slightly less than semi-circular shaped bends 20 in the members 10 and 12 at substantially the midpoint of the lower horizontal portion 14 of each of the members 10 and 12. As the bends 20 of members 10 and 20 are not completely enclosed, a pair of clam shell retainers 32 is proved to enclose the bends 20 to prevent the members 10 and 12 from slipping apart.

As shown more clearly in FIG. 2, each clam shell retainer 32 includes a concave retainer portion 34 and a flange portion 36. An aperture 38 is formed through the center of each retainer 32 and each aperture 38 is sized to accommodate the bolt 18 therein in an assembled position.

In an assembled position, the concave portion 34 of each retainer 32 is placed over the bend portion 20 of one of the members 10 or 12, such that the flange portion 36 of each retaner 32 extends over the open portion of the respective bend 20 and retains the members 10 and 12 in a fixed position relative to the bolt 18. A flat washer 40 is further provided to accommodate the pivotal movement of members 10 and 12 from a storage position to an assembled position.

EMBODIMENT OF FIG. 3

Figure 3:
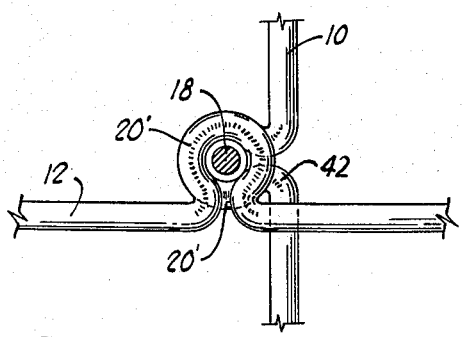
FIG. 3 is another embodiment of the pivotal connection between the rack members.

FIG. 3 shows an alternative embodiment of the pivotal connection shown in FIGS. 1 and 2. The bend portion 20' of FIG. 3 are essentially closed rather than being essentially semi-circular to form what is essentially a ring in each of the members 10 and 12. With this arrangement, the members 10 and 12 are pivotally connected by means of a bolt 18 extending through the apertures formed by the ring-shaped bend portions 20' and is secured therein by a wing nut (not shown).

The small opening of each ring-shaped bend portion 20' may be closed by spot welding the adjacent portions of the wire member, if desired. Also the sides of the bend portions 20' may be roughened or knurled as indicated at 42 to increase the friction between the bend portions 20' when the rack is in operative position to prevent accidental folding of the wire members 10 and 12.

Changes may be made in the combinations and arrangements of parts or elements as heretofore set forth in the specification and shown in the drawing without departing from the spirit and scope of the invention as set forth in the following claims.

What is claimed is:

1. A rack for storing newspapers, comprising:

a pair of crossed pivotally connected wire members, each of said wire members including:

a substantially flat lower horizontal portion having an at least semicircular shaped bend intermediate its ends aligned with the similar portion of the other member;

a pair of upwardly and inwardly slanting portions each connected to the horizontal portion in spaced apart relation;

an upper horizontal portion extending outwardly from the upper end of each slanting portion;

an upper vertically extending portion; and means pivotally connecting said semicircular shaped bend portions, said pivotally connecting means including:

an apertured clam shell-shaped retainer partially enclosing the upper bend;

an apertured clam shell-shaped retainer partially enclosing the lower bend; and a bolt fastener extending though the bends and the retainers holding the retainers and bends in assembled relation.

* * * * *